US005391296A

United States Patent [19]

Rotundo et al.

[11] Patent Number: 5,391,296

[45] Date of Patent: Feb. 21, 1995

[54] POOL SKIMMER DEFLECTING DEVICE

[76] Inventors: David A. Rotundo, 9918 Mollyknoll Ave., Whittier, Calif. 90603; Peter J. Pantazes, 5512 Donner Ave., Buena Park, Calif. 90621

[21] Appl. No.: 177,407

[22] Filed: Jan. 5, 1994

[51] Int. Cl.[6] ..... E04H 4/12; E04H 4/06

[52] U.S. Cl. ..... 210/169; 210/242.1; 4/490; 4/496; 403/76; 403/122

[58] Field of Search ..... 403/76, 122; 210/169, 210/242.1; 4/490, 496; 15/1.7

[56] References Cited

U.S. PATENT DOCUMENTS

| | | | |
|---|---|---|---|
| 2,920,478 | 1/1960 | Golay | 55/67 |
| 3,152,076 | 10/1964 | Kreutzer | 210/242.1 |
| 3,244,284 | 4/1966 | Shaffer | 210/169 |
| 3,663,263 | 5/1972 | Bodre et al. | 210/198.2 |
| 3,774,767 | 11/1973 | Field | 210/169 |
| 3,775,309 | 11/1973 | Ito et al. | 210/657 |
| 3,808,125 | 4/1974 | Good | 210/198.2 |
| 3,820,660 | 6/1974 | Halasz et al. | 55/386 |
| 3,822,530 | 7/1974 | Fuller et al. | 55/386 |
| 3,856,669 | 12/1974 | Ito et al. | 210/657 |
| 4,154,678 | 5/1979 | Kole | 210/97 |
| 4,155,846 | 5/1979 | Novak et al. | 210/198.2 |
| 4,207,188 | 6/1980 | Tsuda et al. | 210/198.2 |
| 4,211,658 | 7/1980 | McDonald et al. | 210/198.2 |
| 4,242,227 | 12/1980 | Nestrick et al. | 55/386 |
| 4,276,179 | 6/1981 | Soehngen | 210/679 |
| 4,483,773 | 11/1984 | Yang | 55/386 |
| 4,541,452 | 9/1985 | Paradis | 210/198.2 |
| 4,551,251 | 11/1985 | Kolobow et al. | 210/198.2 |
| 4,591,442 | 5/1986 | Andrews | 210/198.2 |
| 4,672,042 | 6/1987 | Ross | 210/649 |
| 4,734,189 | 3/1988 | Page, Jr. | 210/169 |
| 4,789,470 | 12/1988 | Wards | 210/169 |
| 4,808,233 | 2/1989 | Pfannkoch | 210/198.2 |
| 4,826,603 | 5/1989 | Hayes et al. | 210/635 |
| 4,828,996 | 5/1989 | Siegel | 210/635 |
| 4,836,928 | 6/1989 | Aoyagi et al. | 210/635 |
| 4,872,979 | 10/1989 | Golay | 210/635 |
| 4,879,028 | 11/1989 | Gibson | 210/169 |
| 4,892,442 | 1/1990 | Shoffner | 264/173 |
| 4,904,379 | 2/1990 | Ward | 210/169 |
| 4,960,514 | 10/1990 | Paskert | 210/169 |
| 4,985,190 | 1/1991 | Ishikawa | 264/122 |
| 5,037,553 | 8/1991 | Del Mar | 210/635 |
| 5,059,314 | 10/1991 | Beckman | 210/169 |
| 5,273,655 | 12/1993 | Del Mar | 210/635 |
| 5,308,493 | 5/1994 | Del Mar | 210/635 |

OTHER PUBLICATIONS

Test Methods For Evaluating Solid Wastes, Physical/-Chemical Methods. SW-846, U.S. Environment Protection Agency, Office of Solid Waste and Emergency Response, 3rd Edition, District of Columbia (1987) pp. (Abstract-1), (3510-1-3510-7), (3520-1-3520-7), and (8080-1-8080-27).

Mikes Laboratory Handbook of Chromatographic and Allied Method, John Wiley, New York, 1979, pp. 424-425.

Snyder, Introduction to Modern Liquid Chromatography, John Wiley, New York, 1979, pp. 86-88.

*Primary Examiner*—Robert A. Dawson

*Assistant Examiner*—Robert James Popovics

[57] ABSTRACT

A deflecting device attachable to a pool edge for guiding surface debris into a pool skimmer. The device includes a clamp adjustably attachable to the pool edge by a pair of thumb screws. A pair of guide rods extend vertically from the clamp and are operable to movably support a floating deflector proximate the pool skimmer to guide surface debris thereinto. The guide rods allow the deflector to travel in a vertical direction to accommodate various fluctuations in surface water level. An alternate embodiment of the present invention includes a deflector formed of a plurality of portions pivotally coupled together such that an impact by a swimmer will uncouple such portions to preclude injury.

7 Claims, 5 Drawing Sheets

POOL SKIMMER DEFLECTING DEVICE

BACKGROUND OF THE INVENTION

1. Field of the Invention

The present invention relates to pool skimmers and more particularly pertains to a pool skimmer deflecting device attachable to a pool edge for guiding surface debris into a pool skimmer.

2. Description of the Prior Art

The use of pool skimmers is known in the prior art. More specifically, pool skimmers heretofore devised and utilized for the purpose of cleaning surface debris from a pool are known to consist basically of familiar, expected and obvious structural configurations, notwithstanding the myriad of designs encompassed by the crowded prior art which have been developed for the fulfillment of countless objectives and requirements.

For example, a skimming apparatus for a swimming pool is illustrated in U.S. Pat. No. 4,960,514 in which an elongated deflector carried by a bracket member deflects and guides surface-water-born dirt, leaves, pollen, and other debris via circulating pool water into the skimmer inlet opening. The bracket member includes an iron plate imbedded therein which may be releasably coupled to a permanent magnet mounted on the pool wall.

A skimmer-diverter assembly for removing debris from swimming pools is described in U.S. Pat. No. 4,904,379 which includes an elongated arm positioned adjacent the skimmer intake of the pool filtration and circulation system. A flow augmenting system is used with the elongated arm to direct an augmented current flow along the arm to enhance the entrainment of debris and direct the debris toward the side wall of the pool and skimmer intake.

Another patent of interest is U.S. Pat. No. 4,879,028 which discloses a debris diverting boom in which a floating boom is movably supported by a bracket attached to the side of the pool. The bracket includes at least two longitudinally-spaced, parallel rods which extend through corresponding spaced vertical holes in the boom to provide for vertical movement of the boom on the bracket.

Other known prior art pool skimmers include U.S. Pat. Nos. 4,154,678, and 5,059,314.

While these devices fulfill their respective, particular objectives and requirements, the aforementioned patents do not disclose a deflecting device for guiding surface debris into a pool skimmer which includes a clamp adjustably attachable to the pool edge by a pair of thumb screws and a pair of guide rods which extend vertically from the clamp to movably support a floating deflector proximate the pool skimmer to guide surface debris thereinto. Furthermore, none of the know prior art pool skimmers teach or suggest a device including the aforementioned structure and further including a deflector formed of a plurality of portions pivotally coupled together such that an impact by a swimmer will uncouple such portions to preclude injury. Finally, the present invention also provides a floating deflector having a expanded tip operable to create small eddy currents which further assist in the removal of surface debris from the pool water.

In these respects, the pool skimmer deflecting device according to the present invention substantially departs from the conventional concepts and designs of the prior art, and in so doing provides an apparatus primarily developed for the purpose of guiding surface debris into a pool skimmer.

SUMMARY OF THE INVENTION

In view of the foregoing disadvantages inherent in the known types of pool skimmers now present in the prior art, the present invention provides a new pool skimmer deflecting device construction wherein the same can be utilized for guiding surface debris into a pool skimmer. As such, the general purpose of the present invention, which will be described subsequently in greater detail, is to provide a new pool skimmer deflecting device apparatus which has many of the advantages of the pool skimmers mentioned heretofore and many novel features that result in a pool skimmer deflecting device which is not anticipated, rendered obvious, suggested, or even implied by any of the prior art pool skimmers, either alone or in any combination thereof.

To attain this, the present invention generally comprises a deflecting device attachable to a pool edge for guiding surface debris into a pool skimmer. The device includes a clamp adjustably attachable to the pool edge by a pair of thumb screws. A pair of guide rods extend vertically from the clamp and are operable to movably support a floating deflector proximate the pool skimmer to guide surface debris thereinto. The guide rods allow the deflector to travel in a vertical direction to accommodate various fluctuations in surface water level. An alternate embodiment of the present invention includes a deflector formed of a plurality of portions pivotally coupled together such that an impact by a swimmer will uncouple such portions to preclude injury.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pool skimmer deflecting device apparatus which has many of the advantages of the pool skimmers mentioned heretofore and many novel features that result in a pool skimmer deflecting device which is not anticipated, rendered obvious, suggested, or even implied by any of the prior art pool skimmers, either alone or in any combination thereof.

It is another object of the present invention to provide a new pool skimmer deflecting device which may be easily and efficiently manufactured and marketed.

It is a further object of the present invention to provide a new pool skimmer deflecting device which is of a durable and reliable construction.

An even further object of the present invention is to provide a new pool skimmer deflecting device which is susceptible of a low cost of manufacture with regard to both materials and labor, and which accordingly is then susceptible of low prices of sale to the consuming public, thereby making such pool skimmer deflecting devices economically available to the buying public.

Still yet another object of the present invention is to provide a new pool skimmer deflecting device which provides in the apparatuses and methods of the prior art some of the advantages thereof, while simultaneously overcoming some of the disadvantages normally associated therewith.

Still another object of the present invention is to provide a new pool skimmer deflecting device attachable to a pool edge for guiding surface debris into a pool skimmer.

Yet another object of the present invention is to provide a new pool skimmer deflecting device which includes a clamp adjustably attachable to the pool edge by a pair of thumb screws, and a pair of guide rods which extend vertically from the clamp to movably support a floating deflector proximate the pool skimmer to guide surface debris thereinto, while simultaneously allowing the deflector to travel in a vertical direction to accommodate various fluctuations in surface water level.

Even still another object of the present invention is to provide a new pool skimmer deflecting device which includes a deflector formed of a plurality of portions coupled together such that an impact by a swimmer will uncouple such portions to preclude injury.

Even still yet another object of the present invention is to provide a new pool skimmer deflecting device which includes a floating deflector having a expanded tip operable to create small eddy currents which further assist in the removal of surface debris from the pool Water.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
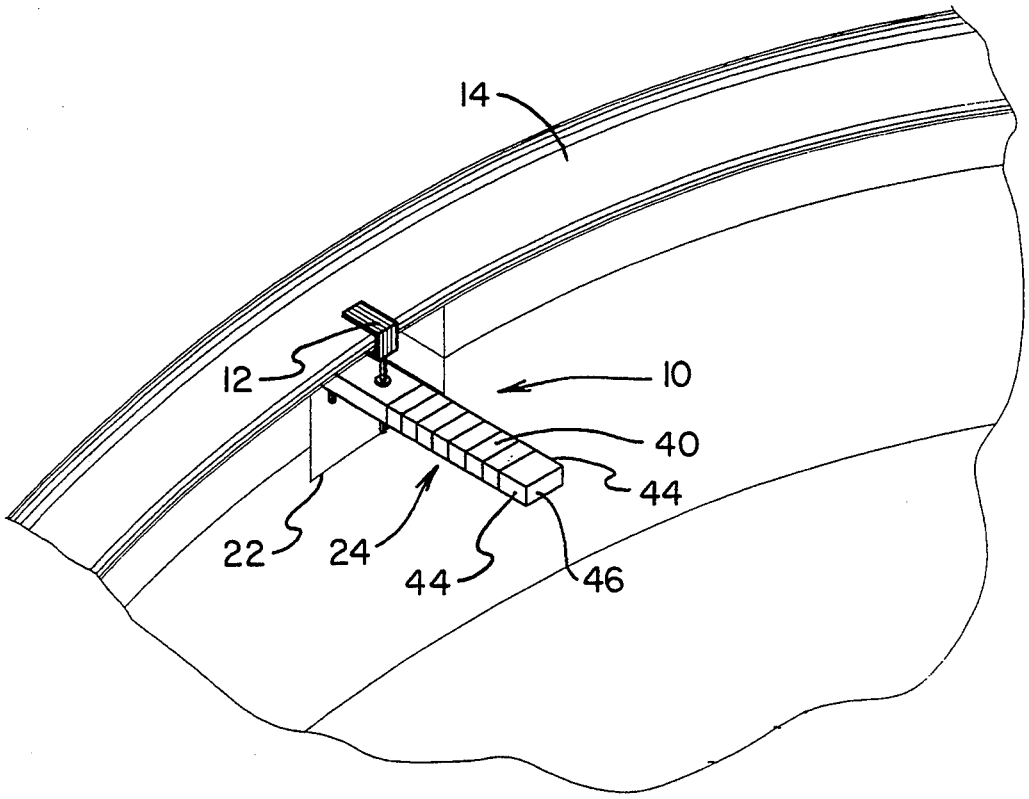
FIG. 1 is a perspective view of a first embodiment of a pool skimmer deflecting device comprising the present invention as installed within a pool.

With reference now to the drawings, and in particular to FIGS. 1–5 thereof, a first embodiment of a new pool skimmer deflecting device embodying the principles and concepts of the present invention and generally designated by the reference numeral 10 will be described.

Figure 2:
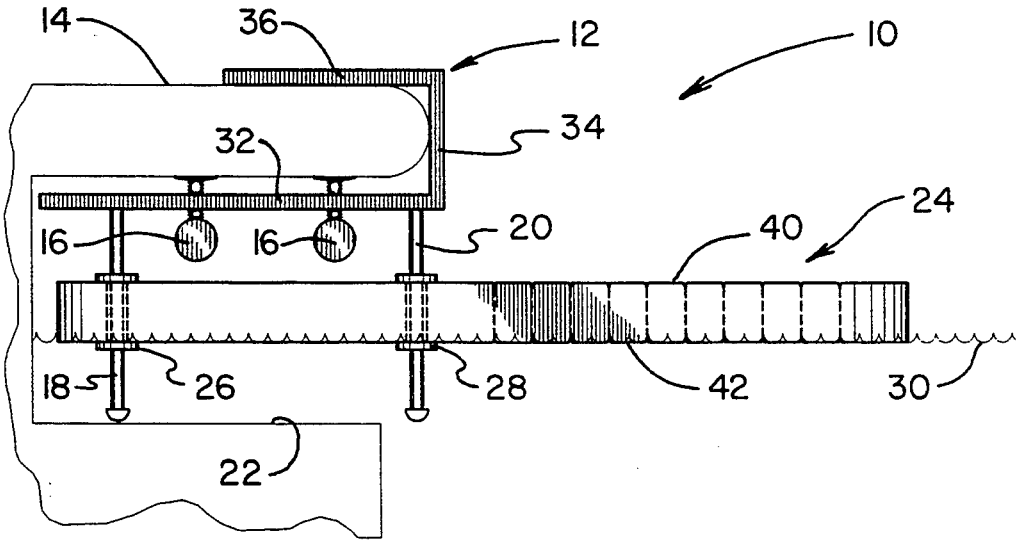
FIG. 2 is a side elevation view of the present invention.

From an overview standpoint, the pool skimmer deflecting device 10 comprises a clamp assembly 12 which may be removably coupled to a pool edge 14 of an associated swimming pool by a pair of thumb screws 16, as best illustrated in FIG. 2. The clamp assembly 12 includes a pair of spaced, vertical, downwardly extending guide rods which project therefrom. The guide rods include an inner guide rod 18 and an outer guide rod 20 of a length which allows either of the guide rods to be positioned within a skimmer 22 forming a part of the pool's circulation system.

Movably supported upon the guide rods 18, 20 is a buoyant deflector 24 having a substantially elongated shape. The deflector 24 includes a through-extending inner guide bushing 26 and outer guide bushing 28 through which the cooperatively spaced guide rods 18, 20 project. The bushings 26, 28 allow the deflector 24 to move vertically and float upon the water's surface 30, as best illustrated in FIG. 2.

In use, the pool skimmer deflecting device 10 may be easily attached to the pool edge 14 proximate the skimmer 22 by a rotational tightening of the thumb screws 16. The deflector 24 is then movably supported by the guide rods 18, 20 such that it will float upon the water surface 30 to engage and guide surface debris into the skimmer 22, whereby such debris may be removed by the pool's circulation and filtration system. The pool skimmer deflecting device 10 guides surface debris into the skimmer 22 which would otherwise not be removed by the intake action of the skimmer alone.

More specifically, it will be noted that the pool skimmer deflecting device 10 comprises a clamp assembly 12 attachable to the pool edge 14 of a pool by a pair of rotatably tightenable thumb screws 16. As best illustrated in FIG. 2, the clamp assembly 12 comprises a lower member 32 orthogonally coupled to a vertical member 34 which, in turn, is orthogonally coupled to an upper member 36 such that the upper member and the lower member are positioned in a spaced, parallel relationship. The lower member 32 includes a pair of spaced, unlabeled threaded apertures through which the thumb screws 16 rotatably project. The thumb screws 16 are operable to capture a portion of the pool edge 14 between the upper member 36 and the lower member 32, thereby releasably retaining the clamp assembly 12 in a desired position. Because two or more thumb screws 16 are utilized to secure the clamp assembly 12 to the pool edge, angular movement of the clamp assembly in the horizontal plane is precluded.

The clamp assembly 12 provides a secure mounting for a pair of spaced guide rods which extend vertically therefrom to support a floating deflector 24 therebeneath. The guide rods include an inner guide rod 18 and an outer guide rod 20 which extend vertically and downwardly from the lower member 32 in a parallel, spaced relationship to one another. The guide rods 18, 20 should be provided with a smooth finish for reasons which will hereinafter become apparent.

Figure 3:
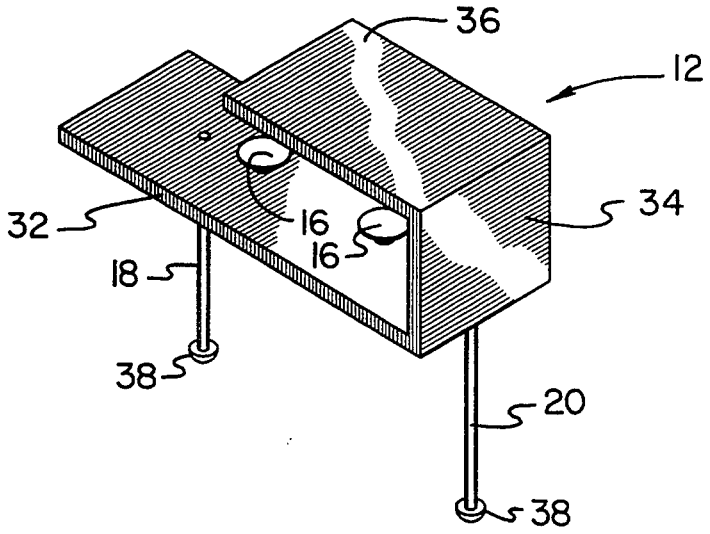
FIG. 3 is a perspective view of a portion of the first embodiment.

Movably supported upon the guide rods 18, 20 is the deflector 24 which includes a pair of unlabeled, through-extending, cooperatively spaced apertures with an inner guide bushing 26 extending through one of such apertures and an outer guide bushing 28 extending through the other aperture. The bushings 26, 28 are concentrically received upon the guide rods 18, 20 to movably support the deflector 24 as illustrated in FIG. 2. The guide rods 18, 20 each include at their lower distal end a retainer 38 which precludes an unintentional separation of the deflector 24 from the rods, as best shown in FIG. 3.

Figure 4:
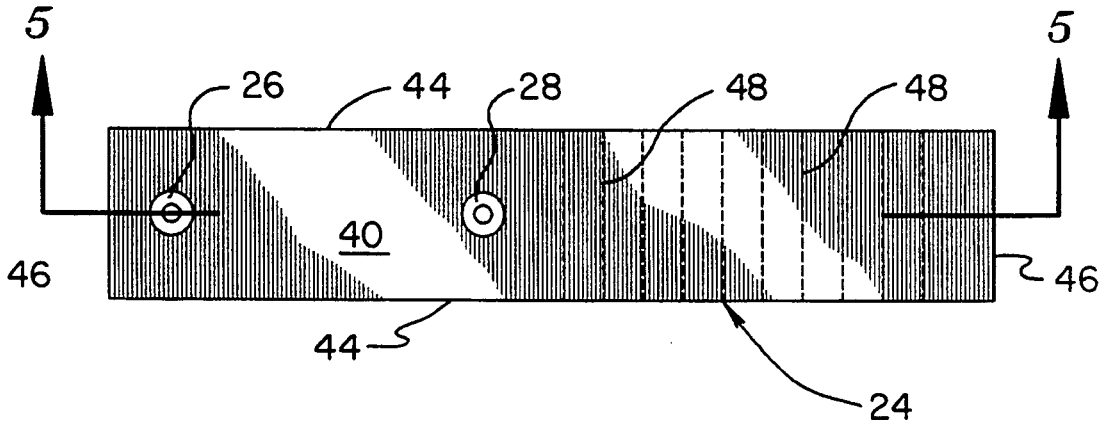
FIG. 4 is a top plan view of the deflector comprising a portion of the present invention.

The deflector 24 may be comprised of any substantially buoyant material which allows the deflector to float at or upon the water surface 30. As best illustrated in FIGS. 1 and 4, it can be shown that the deflector 24 includes both a top wall 40 and a bottom wall 42 which extend longitudinally in a parallel, spaced relationship and are supported as such by a pair of respectively opposed side walls 44 and end walls 46 which cooperatively define a substantially rectangular shape. The deflector 24 may be formed of a light-weight material having a specific gravity less than one, such as a foam material or the like illustrated in FIG. 5. Additionally or alternatively, the deflector 24 may be comprised of a plastic material or the like and provided with at least one hollow interior cavity to impart buoyancy to the deflector.

Figure 5:
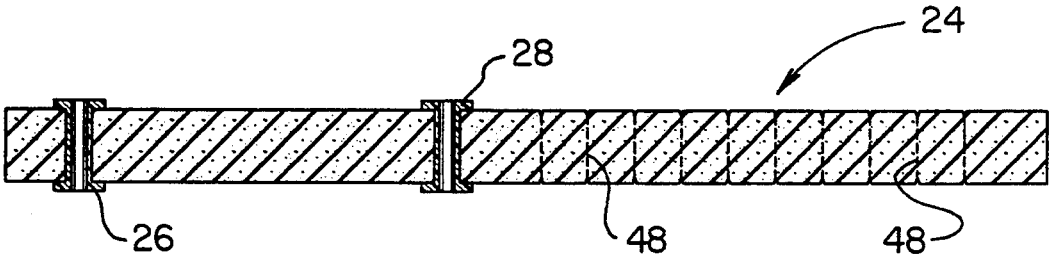
FIG. 5 is a cross sectional view taken along line 5—5 of FIG. 4.

To preclude injury upon an impacting of the device 10 by a swimmer, the deflector 24 may be provided with a plurality of frangible areas 48 which allow the deflector to fracture along such areas. As best illustrated in FIGS. 4 and 5, the frangible areas comprise adjoining circumferential notch means in the side walls 44 and the top and bottom walls 40, 42 such that the deflector may fracture upon impact from either a horizontal, or vertical impact, respectively. In other words, the vertical notches encourage fracturing of the deflector 24 upon impact by a swimmer swimming in the pool, and the horizontal notches encourage fracturing of the deflector should it be struck from a vertical direction by a person jumping in the pool. This arrangement allows the pool skimmer deflecting device 10 to be left in the pool at all times without interfering with the safety of the pool environment.

In use, the pool skimmer deflecting device 10 may be easily attached to the pool edge 14 proximate the skimmer 22 by a rotational tightening of the thumb screws 16. The deflector 24 is then movably supported by the guide rods 18, 20 such that it will float upon the water surface 30 to engage and guide surface debris into the skimmer 22, whereby such debris may be removed by the pool's circulation and filtration system. The pool skimmer deflecting device 10 guides surface debris into the skimmer 22 which would otherwise not be removed by the intake action of the skimmer alone.

Figure 7:
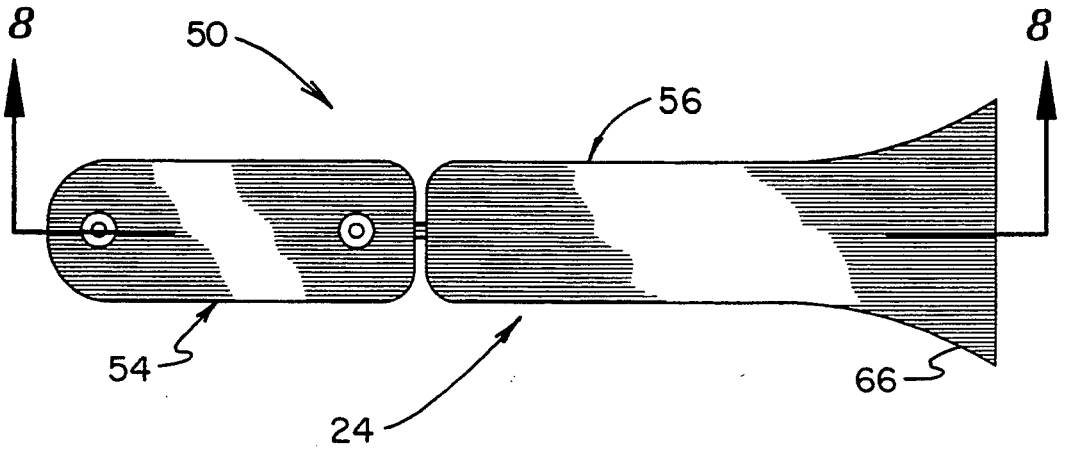
FIG. 7 is a top plan view of the portion of the second embodiment illustrated in FIG. 6.
Figure 8:
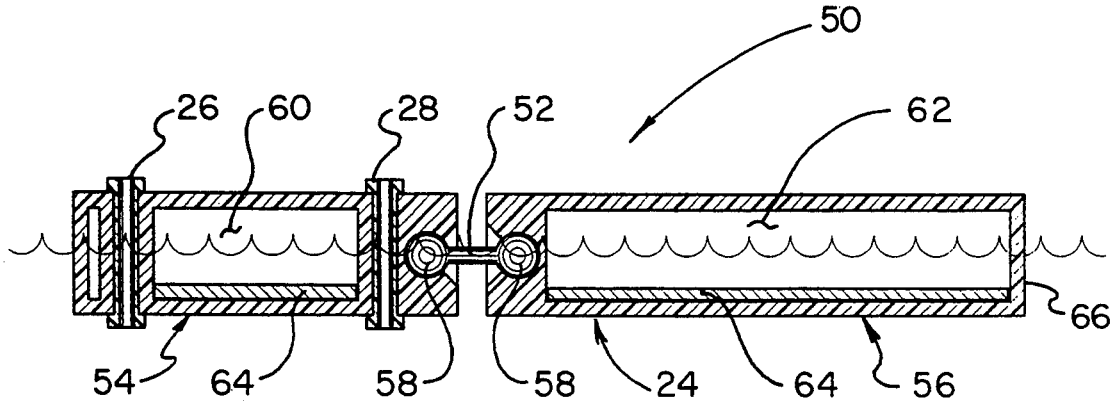
FIG. 8 is a cross sectional view taken along line 8—8 of FIG. 7 of the second embodiment.

A second embodiment of the present invention, as generally designated by the reference numeral 50, which comprises substantially all of the features and structure of the foregoing embodiment 10 and which further comprises a deflector 24 formed of a plurality of portions pivotally coupled together by a connector 52. As best shown in FIGS. 6–9, it can be shown that deflector 24 of the second embodiment 50 comprises an interior portion 54 through which the inner and outer bushings 26, 28 project. The deflector 24 further comprises an exterior portion 56 which is pivotally coupled to the interior portion 54 by the connector 52, as best shown in FIGS. 7–8.

The interior portion 54 and the exterior portion 56 are each provided with an unlabeled sphere cavity. The connector 52 includes a pair of spaced spheres 58, one of which may be received within one of the sphere cavities of either the interior portion 54 or the exterior portion 56 to provide a pivotal link between the two portions. More specifically, the spheres 58 will snap into the sphere cavities, such that an impact by a swimmer or the like against the deflector 24 will result in the uncoupling of the exterior portion 56 from the interior portions 54. Subsequent to such uncoupling, the portions 54, 56 may once again be snapped together. This arrangement allows the deflector 24 to withstand impacts without a damage to either the deflector or the impacting persons or objects.

While the deflector 24 of the second embodiment 50 may be comprised of any substantially buoyant material, it is preferable that the portions 54, 56 be comprised of a resilient plastic which provides the snap action described above. To provide the necessary buoyancy to the deflector 24, it is desirable that the interior portion 54 be provided with an interior portion buoyant cavity 60 and the exterior portion 56 be provided with an exterior portion buoyant cavity 62, as best illustrated in FIG. 8. In addition, the buoyant cavities 60, 62 may include weights 64, with such weights being particularly useful in the exterior portion 56 to preclude a rotational movement about its horizontal or longitudinal axis.

Figure 6:
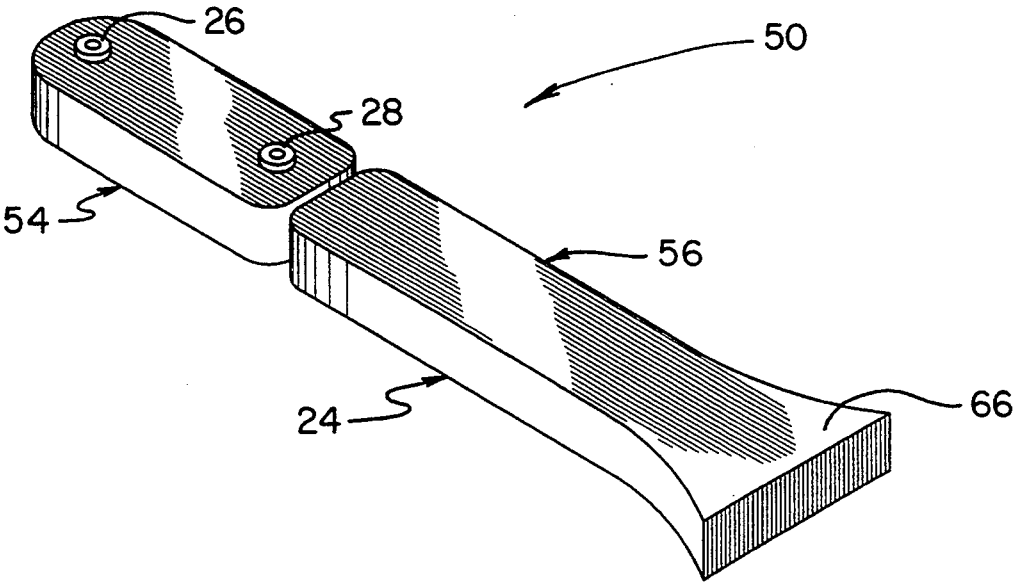
FIG. 6 is a perspective view of a portion of a second embodiment of a pool skimmer deflecting device comprising the present invention.
Figure 9:
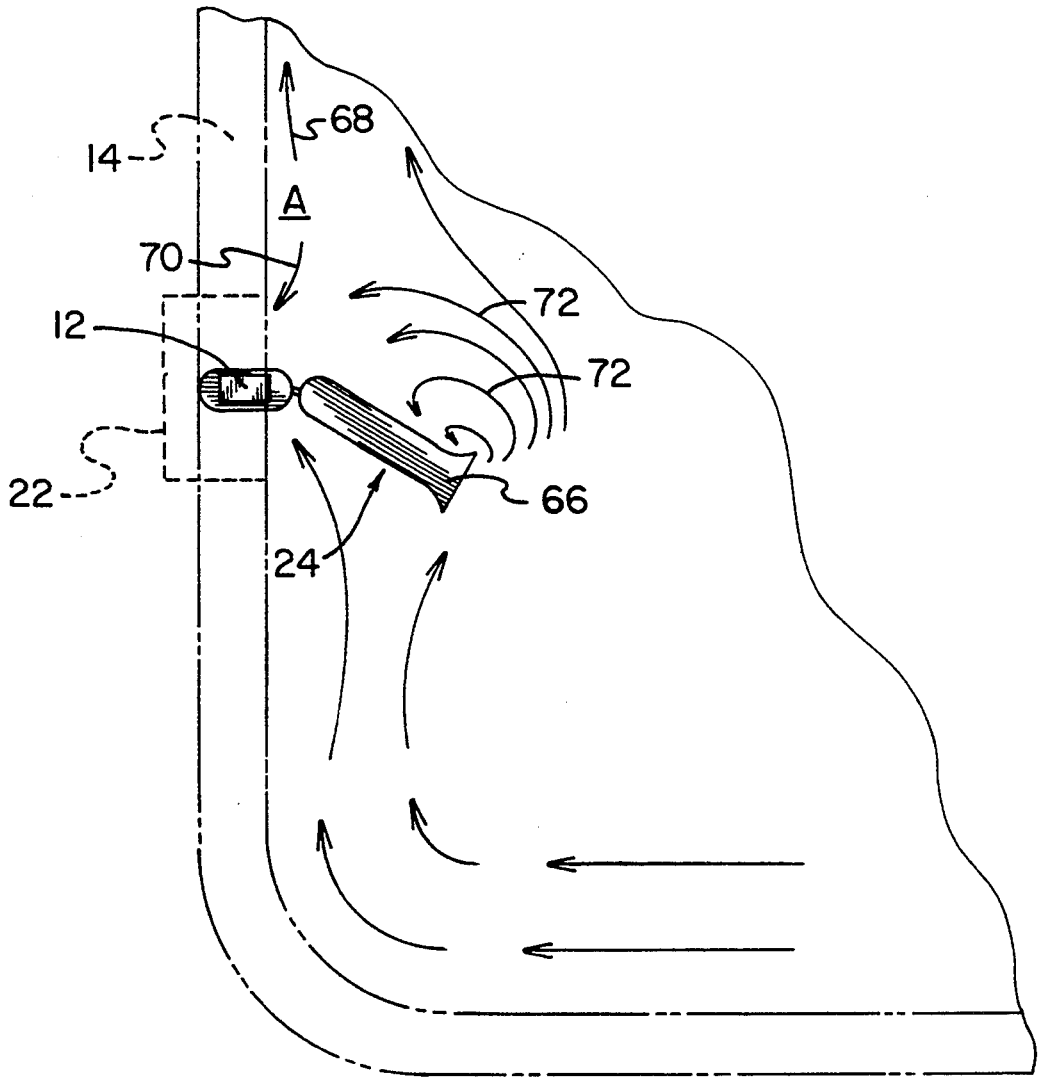
FIG. 9 is a top plan view of a pool having the pool skimmer deflecting device installed therein illustrating the surface currents generated thereby.

As best illustrated in FIGS. 6 and 8, it can be shown that the deflector 24 is provided with a fluted tip 66 at a distal end of the exterior portion 56. The fluted tip 66 is operable to encourage upstream surface currents towards the skimmer 22 and, as illustrated in FIG. 9, create eddy currents downstream or behind the deflector 24. The creation of such eddy currents encourages surface debris from area A toward the skimmer 22. More specifically, it has been found that the circulation flow of the pool water as indicated by arrow 68 is canceled by the inward suction flow of the skimmer 22 as indicated by the arrow 70, thereby resulting in the creation and maintenance of a stagnant area A. However, the fluted tip 66 creates eddy currents, as indicated by the arrows 72, which cooperate together to bias surface debris from the area A into the skimmer 22.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pool skimmer deflecting device comprising:

a clamp assembly releasably securable to a pool edge;

an inner guide rod extending downwardly, substantially vertically from said clamp assembly;

an outer guide rod extending downwardly, substantially vertically from said clamp assembly, said outer guide rod being spaced from and substantially parallel to said inner guide rod;

a buoyant deflector having a pair of spaced, through-extending apertures, said buoyant deflector comprising a top wall supported in a spaced, substantially parallel relationship to a bottom wall by a pair of spaced side walls orthogonally coupled to both said top wall and said bottom wall, and a pair of spaced end walls substantially orthogonally coupled to said side walls, said top wall, and said bottom wall, said buoyant deflector including at least one frangible area which separates upon impact, said at least one frangible area comprising adjoining circumferential notch means in said side walls, said top wall, and said bottom wall, such that said deflector will fracture upon impact with a swimmer;

and, a pair of bushings, one of said bushings being positioned within one of said apertures and another of said bushings being positioned within another of said apertures, said bushings being concentrically received upon cooperatively spaced guide rods to movably support said deflector proximate said pool edge.

2. The pool skimmer deflecting device of claim 1, wherein said buoyant deflector has a distal end and is shaped so as to define an expanded tip at said distal end thereof.

3. A pool skimmer deflecting device comprising:

a clamp assembly releasably securable to a pool edge;

an inner guide rod extending downwardly, substantially vertically from said clamp assembly;

an outer guide rod extending downwardly, substantially vertically from said clamp assembly, said outer guide rod being spaced from and substantially parallel to said inner guide rod;

a buoyant deflector having a pair of spaced, through-extending apertures and at least one frangible area which separates upon impact, said deflector comprising an interior portion pivotally coupled to an exterior portion, said interior portion having a sphere cavity and said exterior portion having a sphere cavity;

a connector having spaced spheres with one of said spheres being received within said sphere cavity of said interior portion and another of said spheres being received in said sphere cavity of said exterior portion to pivotally couple said portions together;

and, a pair of bushings, one of said bushings being positioned within one of said apertures and another of said bushings being positioned within another of said apertures, said bushings being concentrically received upon cooperatively spaced guide rods to movably support said deflector proximate said pool edge.

4. The pool skimmer deflecting device of claim 3, wherein said sphere cavities are formed of a substantially resilient material such that said spheres will snap into respective sphere cavities.

5. The pool skimmer deflecting device of claim 4, wherein said exterior portion has a distal end and is shaped so as define an expanded tip at said distal end thereof.

6. The pool skimmer deflecting device of claim 5, wherein said interior and exterior portions are formed of a substantially resilient material with said interior portion having an interior portion buoyant cavity and said exterior portion having an exterior portion buoyant cavity.

7. The pool skimmer deflecting device of claim 6, and further comprising a pair of weights with one of said weights being positioned in said interior portion buoyant cavity and another of said weights being positioned in said exterior portion buoyant cavity.

* * * * *